US008075260B2

(12) United States Patent
Aki et al.

(10) Patent No.: US 8,075,260 B2
(45) Date of Patent: Dec. 13, 2011

(54) CENTRIFUGAL TURBOMACHINERY

(75) Inventors: Takashi Aki, Tsuchiura (JP); Akira Manabe, Kasumigaura (JP); Sadashi Tanaka, Kasumigaura (JP); Takaki Fukuchi, Tsuchiura (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 774 days.

(21) Appl. No.: 11/698,211

(22) Filed: Jan. 26, 2007

(65) Prior Publication Data

US 2007/0217909 A1 Sep. 20, 2007

(30) Foreign Application Priority Data

Mar. 20, 2006 (JP) ..... 2006-075878

(51) Int. Cl.
*F04D 29/44* (2006.01)

(52) U.S. Cl. ..... 415/199.2; 415/211.2

(58) Field of Classification Search ..... 415/191, 415/199.2, 199.3, 211.2; 417/250
See application file for complete search history.

(56) References Cited

U.S. PATENT DOCUMENTS 5,344,285 A * 9/1994 O'Sullivan et al. ..... 415/199.2
6,162,015 A * 12/2000 Nagai et al. ..... 415/199.2
7,338,255 B2 * 3/2008 Nabesaka et al. ..... 415/173.6

FOREIGN PATENT DOCUMENTS

JP 11-324987 A 11/1999
JP 11324987 A * 11/1999
JP 2005-282548 10/2005

OTHER PUBLICATIONS

First Chinese Office Action mailed Aug. 29, 2008 and English translation thereof.
Second Chinese Office Action mailed Apr. 24, 2009 and English translation thereof.

* cited by examiner

*Primary Examiner* — Edward Look
*Assistant Examiner* — Ryan Ellis
(74) *Attorney, Agent, or Firm* — Crowell & Moring LLP

(57) ABSTRACT

A centrifugal turbomachinery in accordance with the present invention can lower a fluid loss in a return flow path. In the centrifugal turbomachinery, a plurality of centrifugal impellers is attached to a rotating shaft, and the centrifugal turbomachinery is provided with a diffuser having a plurality of blades introducing a fluid boosted by a front stage impeller to a rear stage impeller, and a return flow path means. The return flow path means has a side plate arranged in a back surface side of the front stage impeller, a plate opposing the side plate and arranged in a front surface side of the rear stage impeller, and a plurality of blades arranged between the side plate and the plate so as to be spaced in a peripheral direction. A maximum diameter portion of the side plate is changed in the peripheral direction.

3 Claims, 3 Drawing Sheets

CENTRIFUGAL TURBOMACHINERY

BACKGROUND OF THE INVENTION

The present invention relates to a turbomachinery such as a pump and a compressor, and more particularly to a centrifugal turbomachinery flowing out a fluid in a centrifugal direction from an impeller.

An example of a conventional centrifugal turbomachinery is disclosed in JP-A-11-324987. In the centrifugal turbomachinery disclosed in this publication, in order to downsize without lowering a fluid performance, on inlet end portion of return blades is located in an inner side in a radial direction than a position in a radial direction of a semi-open portion passage. Further, a circular pipe shaped space continuously provided with the semi-open portion passage is formed in an outer side in the radial direction than the return blade inlet side end portion. Accordingly, a stream flowing out from the semi-open portion passage can flow in without being regulated by a plurality of return blades arranged in a peripheral direction so as to form a circular blade row, and a loss at a time of flowing into the return blade is lowered.

SUMMARY OF THE INVENTION

Unless a water return blade inlet side end portion is located in the inner side in the radial direction than the position in a radial direction of the semi-open portion passage, a number of the semi-open portion passage becomes equal to a number of the blades of a diffuser. Further, in order to prevent the water return blade from interrupting the flow which is flown out from the semi-open portion passage, it is necessary to make the blade number of the water return blade equal to the number of the semi-open portion passage. In the fluid machinery described in the publication mentioned above, it is possible to optionally select the blade number of the water return blade, however, it is hard to necessarily optionally select the blade number of the diffuser due to the following reasons.

The blade number of the diffuser relates to a stall of the flow in the diffuser. If the stall of the flow is generated in the diffuser, an unstable phenomenon is generated in a head curve. On the other hand, if the blade number of the return blade is not proper, a velocity distribution of the stream flowing out from the return blade is distorted, and an efficiency of the next-stage impeller in a downstream side of the return blade is lowered. As a result, the blade numbers of the diffuser and the return blade are closely related with each other, and it is impossible to freely select both the elements. In this case, since the velocity distribution of the stream flowing out from the semi-open portion passage is changed in correspondence to the shape of the semi-open portion passage, the loss of the return blade positioned in the downstream side of the semi-open portion passage is increased in accordance with the shape of the semi-open passage.

The present invention is made in consideration of the problems of the prior art mentioned above, and an object of the present invention is to lower a fluid loss in a centrifugal turbomachinery. The other object of the present invention is to achieve a compact structure without lowering a fluid performance of a centrifugal turbomachinery.

In order to achieve the object mentioned above, in accordance with one aspect of the present invention, there is provided a centrifugal turbomachinery comprising a plurality of centrifugal impellers attached to a rotating shaft, a diffuser having a plurality of blades introducing a fluid boosted by a front stage impeller to a rear stage impeller, and a return flow path means, wherein the return flow path means has a side plate arranged in a back surface side of the front stage impeller, a plate facing to the side plate and arranged in a front surface side of the rear stage impeller, and a plurality of impeller blades arranged between the side plate and the plate so as to be spaced in a peripheral direction, and an outer diameter portion of the side plate is changed in the peripheral direction.

Further, in this aspect, it is preferable to set a maximum position of the outer diameter position of a plurality of blades of the return flow path means below a maximum diameter position of the side plate, and the outer diameter portion of the side plate is preferably made larger in a concave surface side of the diffuser blade and smaller in a convex surface side of the diffuser blade. Further, it is preferable to set the blade number of the diffuser equal to or less than the impeller blade number of the return flow path means, and it is desirable that the impeller has a side plate arranged in a flow suction side and a core plate arranged in the next stage side, and an outer diameter of the blade of the diffuser is smaller in the core plate side of the impeller and larger in the side plate side of the impeller.

Further, it is preferable that the semi-open portion flow path is formed in an outer side than an outer diameter portion of the side portion and in an inner side than a maximum outer diameter portion of the side plate, and a position in a peripheral direction of the semi-open portion exists in a leading end portion of the blade of the return flow path starting from a suction surface of the diffuser blade, and it is preferable that the outer diameter portion of the side plate is smoothly connected to the suction surface of the blade of the return flow path in a cross section of the centrifugal turbomachinery.

In accordance with the present invention, since the outer diameter position of the return flow path is changed in the peripheral direction in the centrifugal turbomachinery, it is possible to lower an impact loss and the like in the blade of the return flow path, and it is possible to lower a fluid loss. Further, since it is possible to shift the return flow path to the inner diameter side without lowering the fluid performance, it is possible to achieve a compact structure.

Other objects, features and advantages of the present invention will become apparent from the following description of the embodiments of the present invention taken in conjunction with the accompanying drawings.

DESCRIPTION OF THE PREFERRED EMBODIMENTS

Figure 1:
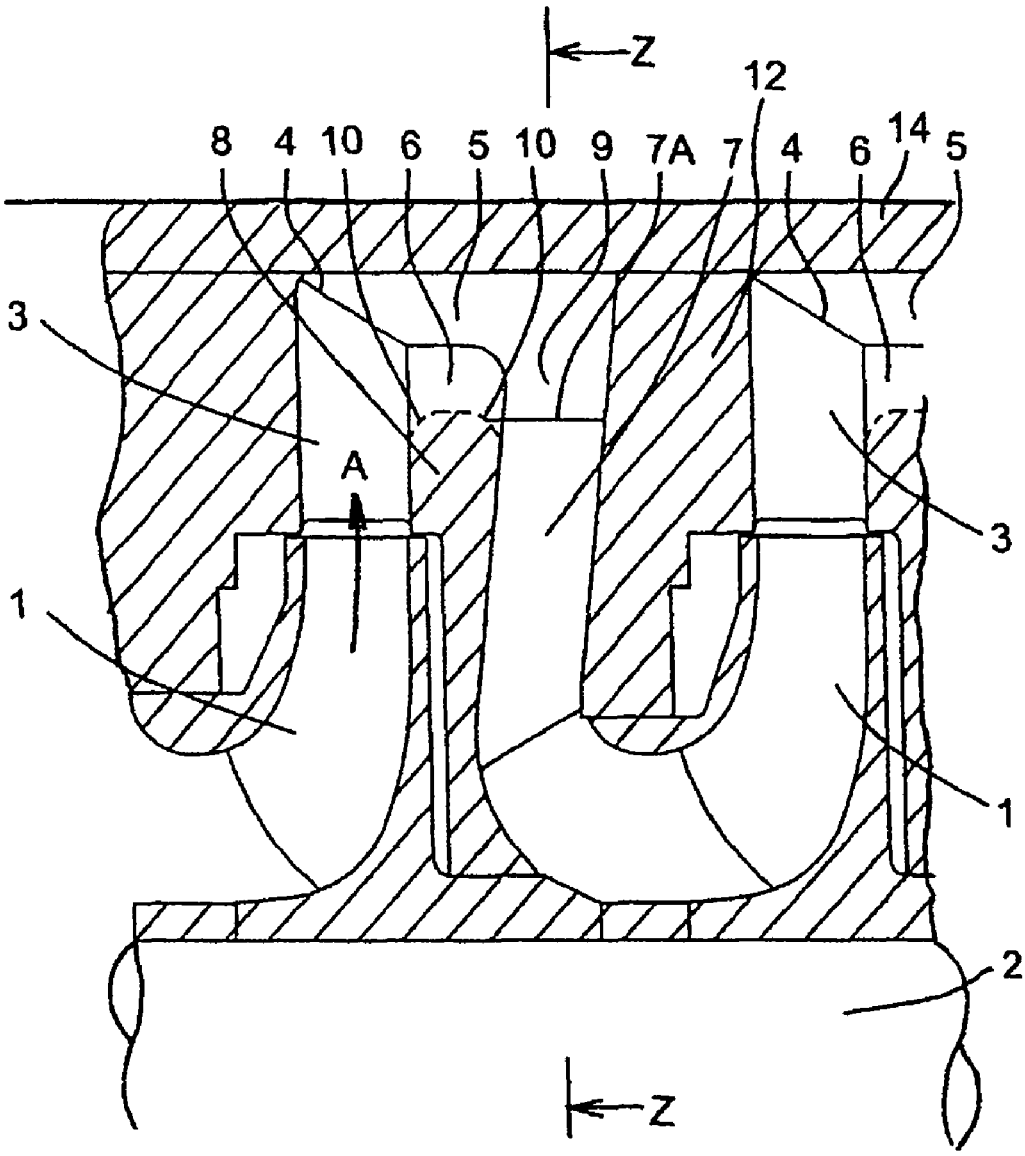
FIG. 1 is a partly vertical cross-sectional view of an embodiment of a centrifugal turbomachinery in accordance with the present invention.
Figure 2:
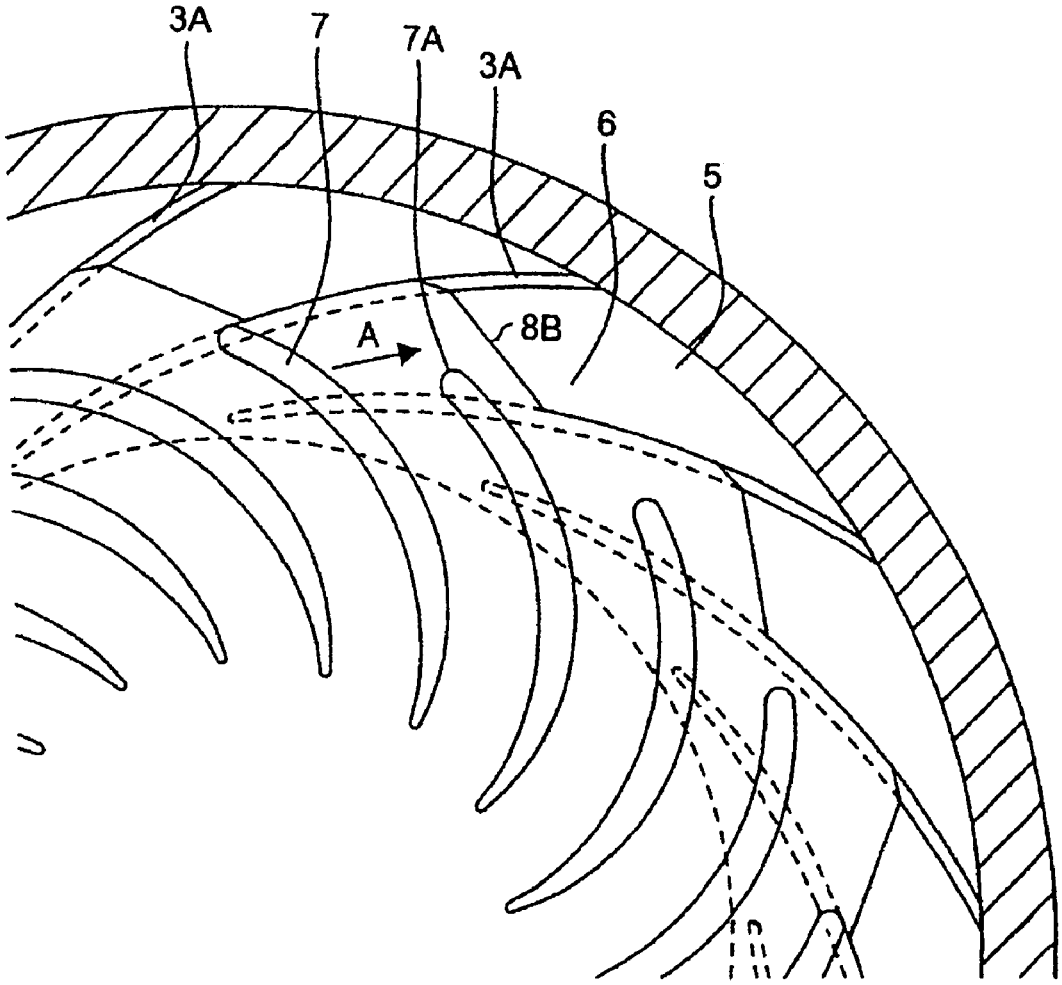
FIG. 2 is a cross-sectional view of an embodiment of a water return blade used in the centrifugal turbomachinery shown in FIG. 1 and corresponds to a view as seen from an arrow Z-Z in FIG. 1.

A description will be given below of several embodiments of a centrifugal turbomachinery in accordance with the present invention with reference to the accompanying drawings. In the following description, a centrifugal pump is exemplified, however, the present invention can be applied in the same manner to every centrifugal turbomachinery. An example of a centrifugal pump 100 is shown in FIGS. 1 and 2. FIG. 1 is a vertical cross sectional view of a main portion of a one-axis multi-stage centrifugal pump, and shows adjacent two stage portions in a middle position.

FIG. 2 is a horizontal cross section of a water return portion of the centrifugal pump 100 shown in FIG. 1, and corresponds to a view as seen from an arrow Z-Z in FIG. 1.

A plurality of impellers 1 are attached to a main shaft 2 coupled to a driving machine (not shown). A diffuser 3 formed by a pair of parallel wall surfaces is formed in a downstream side corresponding to an outer side in a radial direction of each of the impellers 1. A plurality of diffuser blades 3A are arranged in the diffuser 3 so as to be spaced in a peripheral direction, and introduce a flow output from the impeller 1 to an outer diameter side. A flow path formed by the diffuser blades 3A is turned in an axial direction by a U-turn flow path 5 corresponding to an outermost diameter portion of the diffuser 3. In this case, in order to change a flow direction of the fluid, a maximum diameter position of the diffuser blade 3A is linearly changed in the axial direction so as to become minimum in a core plate side of the impeller 1. An outlet portion 4 of the diffuser 3 is formed as mentioned above.

The U-turn flow path 5 is connected to a flow path formed between a side plate 8 arranged in a back surface in the core plate side of the impeller 1, and a stage plate 12 arranged in a front surface of a side plate side of the next stage impeller 1. A plurality of water return blades 7 formed in a blade shape are formed in the side plate 8 so as to be spaced in a radial direction. The water return blades 7 may be provided in the side plate 8, or may be provided in the stage plate. Further, they may be provided in both of them. The side plate 8 and the stage plate 12 are held by a casing 14.

A description will be given below of a flow of the centrifugal pump 100 structured as mentioned above. The flow going out of the front stage impeller 1 flows outward in the radial direction while attenuating a swirling component along the diffuser blade 3A by the diffuser 3 portion. At this time, since a flow path area of the diffuser 3 is increased little by little in the radial direction, the flow of the fluid shown by an arrow A is decelerated. Since the flow is decelerated, a speed energy is converted into a pressure energy. The decelerated fluid is discharged to the U-turn flow path 5 in the outlet portion 4 of the diffuser 3, and is introduced to the next stage impeller 1 from the U-turn flow path 5 via the water return blade 7 portion.

Next, a description will be given of details of the U-turn flow path 5 portion. As shown in FIG. 2, a radial position of an outer diameter portion 8B of the side plate 8 is changed in a peripheral direction. In other words, it becomes longer in a concave surface side of the diffuser blade portion 3A and shorter in a convex surface side. Accordingly, a semi-open flow path 6 is formed in an inlet portion of the water return blade 7. An inlet side end portion 7A of the water return blade 7 arranged in a circular blade lattice shape is positioned in an inner side in a diametrical direction than a position in a diametrical direction of the semi-open portion flow path 6. Therefore, a ring-shaped space 9 continuously provided with the U-turn flow path 5 and the semi-open portion flow path 6 is formed in an outer side in a diametrical direction of the inlet side end portion 7A of the water return blade 7.

Further, in the outer diameter portion 8B of the side plate 8, a curved surface portion 10 is formed in a corner portion corresponding to an end portion in an axial direction. The curved surface portion 10 is provided for suppressing a loss caused by a peeling generated in the flow at a time when the flow going out of the diffuser 3 is turned to the axial direction from the outward direction in the diametrical direction and turned to the inward direction in the diametrical direction from the axial direction.

In the embodiment shown in FIG. 1, the blade number of the water return blades 7 is made larger than the blade number of the diffuser 3. Specifically, the blade number of the water return blade 7 is set to sixteen, and the blade number of the diffuser 3 is set to twelve. In this case, the blade numbers of the water return blades 7 and the diffuser 3 can employ the other blade combinations as far as the blade number of the diffuser 3 is smaller than the blade number of the water return blades 7.

Each of the blade numbers is set as mentioned above for the following reasons. If the blade number of the diffuser 3 is made smaller than the blade number of the water return blades 7, a conversion amount of converting the speed energy held by the flow going out of the impeller 1 into the pressure energy is small, and the fluid flows into the water return blade 7 in a state in which a deceleration is insufficient. As a result, the friction loss increased in correspondence to the flow velocity is increased in the downstream side than the diffuser 3. Accordingly, in the present embodiment, the blade number is set to be minimum under a condition that the conversion amount from the speed energy into the pressure energy comes to a predetermined amount. A stall is suppressed by setting the blade number as mentioned above, and the unstable phenomenon in the head curve can be avoided.

In this case, if the blade number of the water return blades 7 is made larger than an allowable maximum number, an area of the flow path formed by the adjacent water return blades 7 is reduced, a flow rate of the stream becomes quick and a friction loss is increased. Accordingly, the blade number is made maximum under a condition that the friction loss is equal to or less than a predetermined set value. If the number of the water return blade 7 is set to an allowable maximum value, the number in the peripheral direction is increased in a region having a slow flow rate generated by a peel flow and a region having a quick flow rate flown out of the flow path formed between the adjacent water return blades 7, in an outlet of the water return blade 7, and the flow flowing out of the water return blade 7 is uniformized in the peripheral direction. If the uniformized flow is flown into the next stage impeller 1 as mentioned above, an efficiency of the next stage impeller 1 is improved.

If the blade number of the water return blades 7 is increased, the stream tends to flow along the water return blades 7 even in the case that the length of the blade of the water return blades 7 is shortened, so that the stream flows in a predetermined direction. As a result, it is possible to position the inlet side end portion 7A of the water return blade 7 closer to the axial side. If the water return blades 7 are arranged in the inner diameter side, it is possible to make the ring-shaped space 9 larger.

It is possible to promote uniformizing the stream flowing out of the U-turn flow path 5 and the semi-open portion flow path 6, on the basis of an increase of the ring-shaped space 9. If the uniformized stream flows into the water return blade 7, a mixing loss or the like in the water return blades 7 is lowered. In this case, if the fluid loss may be equal to that before shifting the position of the water return blade to the axial side, the U-turn flow path can be shifted to the axial side at such a degree as to shift the position of the water return blade, so that it is possible to downsize the centrifugal pump.

Figure 3:
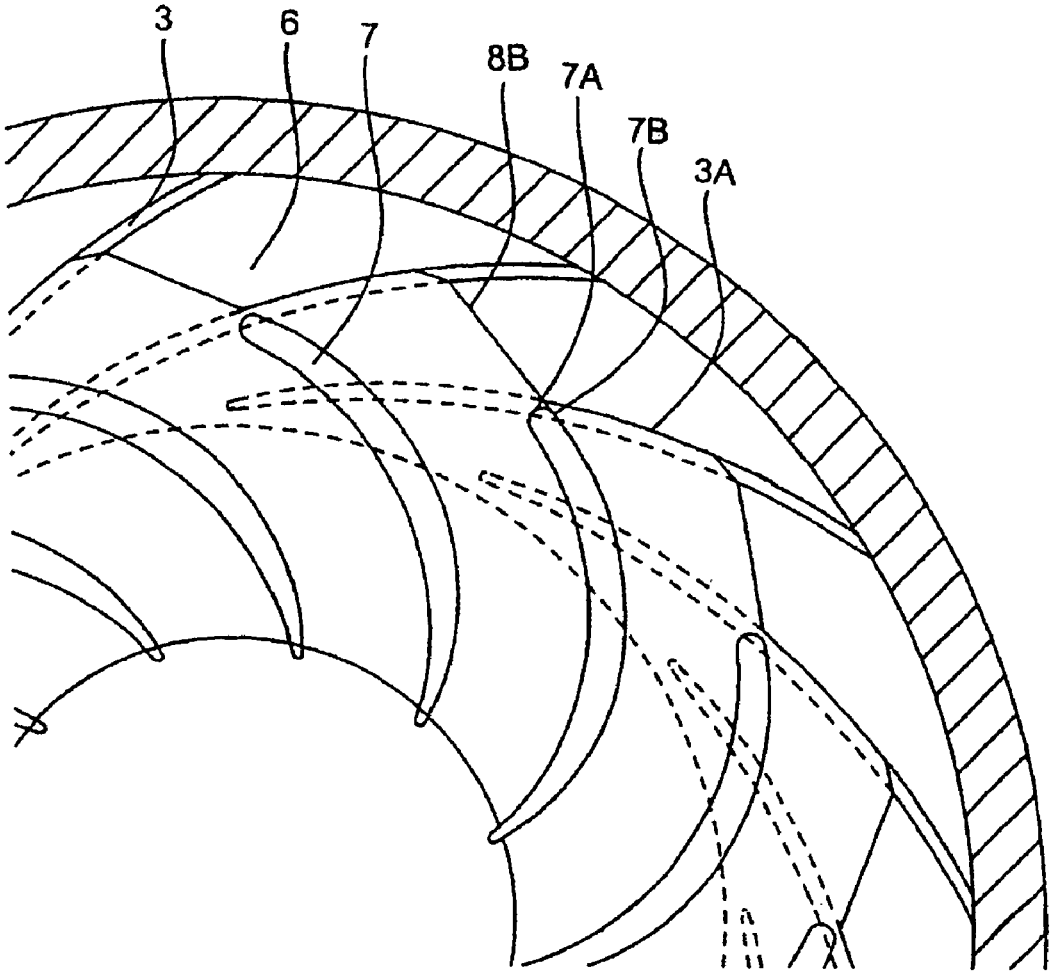
FIG. 3 is a cross-sectional view of the other embodiment of the water return blade used in the centrifugal turbomachinery shown in FIG. 1 and corresponds to a view as seen from an arrow Z-Z in FIG. 1.

A description will be given of the other embodiment of the centrifugal pump in accordance with the present invention with reference to FIG. 3. In the present embodiment, the combination between the blade number of the diffuser 3 and the blade number of the water return blades 7 is changed from the embodiment mentioned above. Specifically, the blade number of the diffuser 3 is set equal to the blade number of the water return blades 7. In this case, the position of the outer diameter portion 8B of the side plate 8 is changed in the peripheral direction in the same manner as the embodiment mentioned above.

The outer diameter portion 8B of the side plate exists at a position of an outlet of the cut diffuser blade 3A in a pressure surface corresponding to a concave surface side of the diffuser blade 3A, and at a position of the inlet side end portion 7A of the water return blade 7 in a suction surface side corresponding to a convex surface side of the diffuser blade 3A. Further, the outer diameter portion 8B is formed by connecting two points by an approximately straight line. The outer diameter portion 8B is brought into contact with the inlet side leading end 7B of the negative pressure surface of the water return blade 7.

In accordance with the present embodiment, it is possible to reduce an angle difference between an angle of the stream flowing out of the semi-open portion flow path 6 formed in the inner diameter side of the U-turn flow path, and an inlet angle corresponding to an angle of the stream flowing into the water return blade 7, and it is possible to lower a collision loss of the stream at a time of flowing into the water return blade 7. Further, the flow peeling tends to be generated in the outer diameter portion 8B of the side plate 8, and the flow rate becomes slow particularly in the inlet side leading end 7B in the water return blade 7 side of the outer diameter portion 8B. Accordingly, it is possible to lower the collision loss of the water return blade 7 by positioning the inlet side end portion 7A of the water return blade 7 in the inlet side leading end 7B.

In accordance with the present embodiment, the blade number of the diffuser 3 is set equal to the blade number of the water return blades 7, however, the blade numbers may be differentiated in the same manner as the embodiment shown in FIG. 2. Even in this case, the outer diameter portion 8B of the side plate 8 is set to the position of the cut portion in the concave surface side of the diffuser 3, and set to the radial position of the inlet side end portion 7A of the water return blade 7 in the convex surface side of the diffuser 3. Accordingly, it is possible to lower the collision loss in the inlet of the water return blade 7. Further, the description is given of the present embodiment by exemplifying the multi-stage centrifugal pump, however, the present invention can be applied to a two-stage or one-stage centrifugal fluid machinery as far as it has a return flow path.

It should be further understood by those skilled in the art that the foregoing description has been made on embodiments of the invention and that various changes and modifications may be made in the invention without departing from the spirit of the invention and the scope of the appended claims.

The invention claimed is:

1. A centrifugal turbomachinery comprising:

a rotating shaft, a plurality of centrifugal impellers mounted on said shaft, a diffuser having a plurality of diffuser blades, and introducing a fluid boosted by a preceding stage impeller to a following stage impeller, and a return flow path means, wherein the return flow path means comprises a side plate located on a back surface side of the preceding stage impeller, a stage plate opposing the side plate and located at a front surface side of the following stage impeller, and a plurality of return blades located between the side plate and the stage plate so as to be spaced in a peripheral direction, an outer diametral portion of the side plate being varied along the peripheral direction, a maximum outer diameter of the plurality of the return blades in the return flow path means is equal to or less than a minimum outer diameter of the side plate, each of said plurality of impellers has an impeller side plate located at a suction flow side, and an impeller core plate adjacent to a following stage having the following stage impeller, an outer diameter of the diffuser blades is varied along an axial direction with the outer diameter of each diffuser blade being smaller at a core plate side of the impeller and large at a side plate side of the impeller, a semi-open flow path is located between an outer periphery of the side plate and a maximum outer diameter of the side plate, a u-turn flow path which is disposed radially outward from the semi-open flow path, and wherein said u-turn flow path begins at the outer periphery of the side plate.

2. A centrifugal turbomachinery as claimed in claim 1, wherein an outer peripheral portion of the side plate is smoothly connected to the suction surface of the return blade in a horizontal cross section of said centrifugal turbomachinery.

3. A centrifugal turbomachinery as claimed in claim 1, wherein a number of the diffuser blades is less than the number of the return blades.

* * * * *